United States Patent [19]

Bergeron

[11] Patent Number: 5,022,820

[45] **Date of Patent: * Jun. 11, 1991**

[54] VARIABLE PITCH PROPELLER

[75] Inventor: Robert M. Bergeron, Whithers Grove, N.H.

[73] Assignee: Land & Sea, Inc., North Salem, N.H.

[ * ] Notice: The portion of the term of this patent subsequent to Dec. 20, 2005 has been disclaimed.

[21] Appl. No.: 449,574

[22] Filed: Dec. 12, 1989

[51] Int. Cl.[5] ..... B63H 1/06

[52] U.S. Cl. ..... 416/89; 416/153; 416/167

[58] Field of Search ..... 416/87, 89, 90 R, 90 A, 416/93 R, 93 A, 147, 153, 154, 163, 164, 165, 106, 107, 113, 135, 140, 156, 157 R, 158

[56] References Cited

U.S. PATENT DOCUMENTS

| | | | |
|---|---|---|---|
| Re. 21,108 | 5/1939 | Zipay | 416/156 |
| 630,499 | 8/1899 | Gorman et al. | 416/113 |
| 1,386,490 | 8/1921 | Boerner | 416/89 |
| 1,389,609 | 9/1921 | Weiher | 416/89 |
| 1,449,685 | 3/1923 | Luther et al. | 416/89 |
| 1,953,682 | 4/1934 | Kelm | 416/89 |
| 2,244,944 | 6/1941 | Humphrey | 63/2 |
| 2,264,568 | 12/1941 | Hamilton | 416/89 |
| 2,282,077 | 5/1942 | Moore | 416/89 |
| 2,282,436 | 5/1942 | Taylor | 416/135 |
| 2,415,421 | 2/1947 | Filippis | 416/89 |
| 2,681,632 | 6/1954 | Rossman | 440/50 |
| 2,682,926 | 7/1954 | Evans | 416/89 |
| 2,742,097 | 4/1956 | Caston | 425/369 |
| 2,870,848 | 1/1959 | Liaaen | 416/163 |
| 2,882,975 | 4/1959 | Hirsch et al. | 416/154 |
| 2,955,659 | 10/1960 | Daley | 416/134 R |
| 2,998,080 | 8/1961 | Moore, Jr. | 416/89 |
| 3,092,186 | 6/1963 | MacLean | 416/162 |
| 3,552,348 | 1/1971 | Shima | 440/50 |
| 3,853,427 | 12/1974 | Holt | 416/167 |
| 4,097,189 | 6/1978 | Harlamert | 416/154 |
| 4,392,832 | 7/1983 | Moberg | 416/89 |
| 4,792,279 | 12/1988 | Bergeron | 416/87 |

FOREIGN PATENT DOCUMENTS

| | | |
|---|---|---|
| 667260 | 7/1963 | Canada . |
| 230132 | 3/1944 | Switzerland . |

*Primary Examiner*—Edward K. Look
*Assistant Examiner*—Hoang Nguyen
*Attorney, Agent, or Firm*—Davis, Bujold & Streck

[57] ABSTRACT

An automatic variable pitch propeller including a central hub defining an axis of propeller rotation and a plurality of blades connected to and extending from the central hub substantially normal to the axis of rotation, each blade being mounted for rotation about a pitch axis, a cam mechanism to translate centrifugal forces imposed on that blade into a force tending to rotate that blade toward a course pitch, that force being opposed by water pressure tending to decrease blade pitch. The cam mechanism including a cam groove formed in an insert, of a material harder than the blades, in each blade shaft and the propeller being provided with variable minimum and maximum blade pitch stops, resilient bias toward minimum blade pitch and manual a pitch-up shift mechanism.

19 Claims, 3 Drawing Sheets

VARIABLE PITCH PROPELLER

The present invention relates to improvements in automatically self-adjusting variable pitch propellers and more particularly, though not exclusively, to marine-type propellers in which a force created by water pressure on the propeller blades is opposed by a force derived from the centrifugal force exerted on these blades to determine propeller blade pitch by way of a cam-cam follower mechanism.

It is known in the art that under conditions when load is high and speed is low, a propeller with a low pitch provides for the most efficient translation of engine power to propulsion. However, when higher propeller speeds are attained, it is known that a propeller with a higher pitch is required to maintain efficiency and prevent engine overreving. Thus, a propeller which has a variable pitch is advantageous in terms of both performance and extended engine life.

The most relevant prior art known to applicant is applicant's own U.S. Pat. No. 4,792,279 which discloses a propeller of the type to which the present invention constitutes an improvement. In this prior art design, the cam profile which controls the blade pitch shifting characteristics of the propeller is machined directly into the blade's support shank for engagement by the cam follower pin supported by the hub of the propeller. Due to the extreme loads involved, this necessitates using materials with a high degree of hardness to prevent excessive wear. Unfortunately, materials with the desirable hardness make poor propeller blades in terms of impact strength and corrosion resistance. Further, machined in cam profiles require replacing the entire blade just to alter the cam profile shape.

Additionally, the propeller of U.S. Pat. No. 4,792,279 provides no means for field adjusting maximum and minimum blade pitch or for initially biasing the blades to their minimum (lowest) pitch setting as is desirable prior to starting from rest or low speed.

Additionally, no means for manually overriding the automatic pitch changes to demand blade upshift from low pitch to high pitch, during operation, is provided in the arrangement of U.S. Pat. No. 4,792,279.

Other U.S. patents known to Applicant are U.S. Pat. Nos. 2,955,659, DALEY; 2,682,926, EVANS; 2,415,421, FILIPPIS; 2,742,097, GASTON; 630,499, GORMAN; 2,264,568, HAMILTON; 3,853,427, HOLT; 2,244,994, HUMPHREY; 1,953,682, KELM; 1,449,685, LUTHER et al; 3,092,186, MacLEAN; 4,392,832, MOBERG; 2,998,080, MOORE; 2,282,077, MOORE; 1,389,609, WEIHER; 2,681,632, ROSSMAN, and 3,552,348, SHIMA. Also known are Canadian Patent 667,260 and Swiss Patent 230,132. All of the above references disclosed variable pitch propeller devices or related technology.

It is an object of the present invention to improve the propeller design disclosed in U.S. Pat. No. 4,792,279.

It is a particular object of the present invention to remove the conflict in choice of materials and heat treatment imposed by forming the cam profile directly into the blade's shank and to provide a means for easily changing the cam profile without necessitating the replacement of complete blades or the whole propeller.

It is a further object of the present invention to provide means for adjusting minimum and maximum blade pitch, means for initially biasing the blades toward minimum pitch and means for manually controlling blade upshift during operation.

According to the invention there is provided an automatic variable pitch marine propeller comprising:

a central hub defining a rotation axis, said central hub having a radial bore receiving a propeller blade shaft, and a guide pin bore receiving a guide pin, said guide pin bore being parallel to said propeller rotation axis and intersecting perpendicularly said radial bore; and a propeller blade comprising said blade shaft and a blade portion, said blade shaft being attached to said blade portion at one end and extending away from said blade portion into said radial bore, said blade shaft being capable of rotation within said radial bore about an axis of pitch rotation, said blade shaft having an opening closely housing a cam defining insert in which is formed a cam groove to receive said guide pin, said blade portion being configured and attached to said blade shaft such that force due to water pressure on said blade portion defines a center of pressure which is located remote from the axis of pitch rotation;

said guide pin passing through a said guide pin bore and being received by said cam groove wherein said cam groove, by way of cooperation between said insert and said shaft, defines pitch of the associated said propeller blade by controlling its rotation within said radial bore about its axis of pitch rotation; wherein during operation of said propeller, by virtue of the interaction of said guide pin with said cam groove and the cooperation of said insert with said shaft, centrifugal force tends to increase pitch and diameter in opposition to said force due to water pressure acting on said propeller blades tending to reduce pitch and diameter.

The present invention in the form of a marine propeller will now be described, by way of example, with reference to the accompanying drawings, in which:

FIG. 3 is a side elevation of a propeller blade of the propeller of the present invention;

FIG. 4 is a side elevation of a propeller assembly incorporating the blade of FIG. 3 shown at maximum pitch;

FIG. 5 is a partial end elevation, as shown by Arrow A in FIG. 4;

FIG. 6 is a fragmentary sectional elevation of an alternative embodiment of the shaft of the blade of FIG. 3 shown in fragmentary cross-sectional elevation of the propeller hub at minimum pitch; and FIG. 7 is an end elevation of the propeller of FIG. 4.

Figure 1:
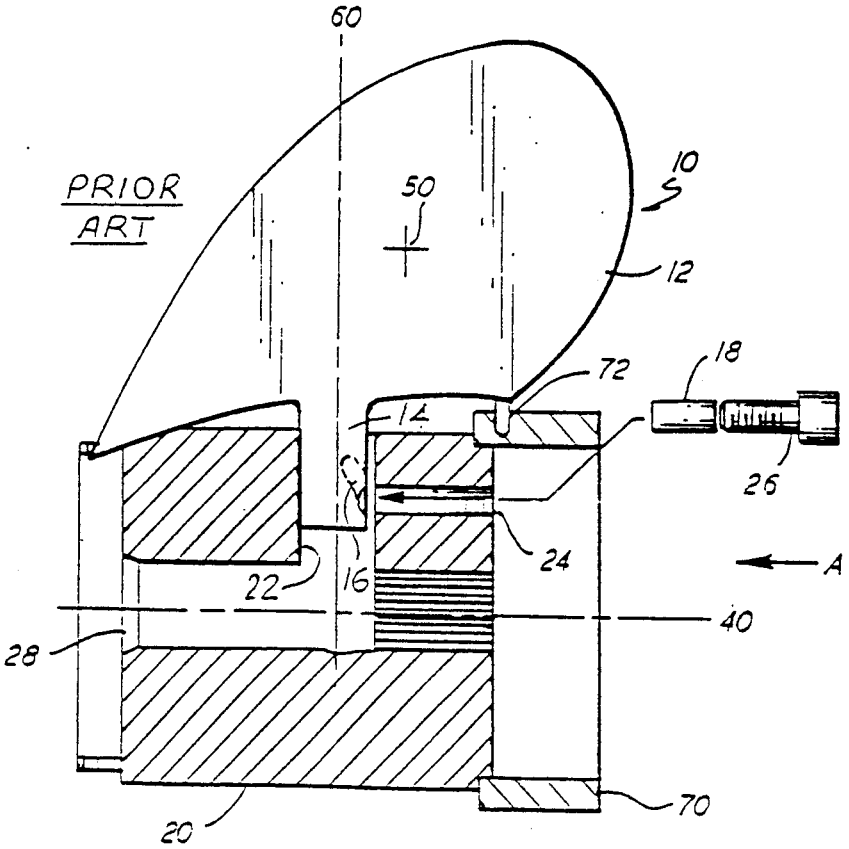
FIG. 1 is a partially cross-sectioned elevation of a propeller assembly according to the prior art.
Figure 2:
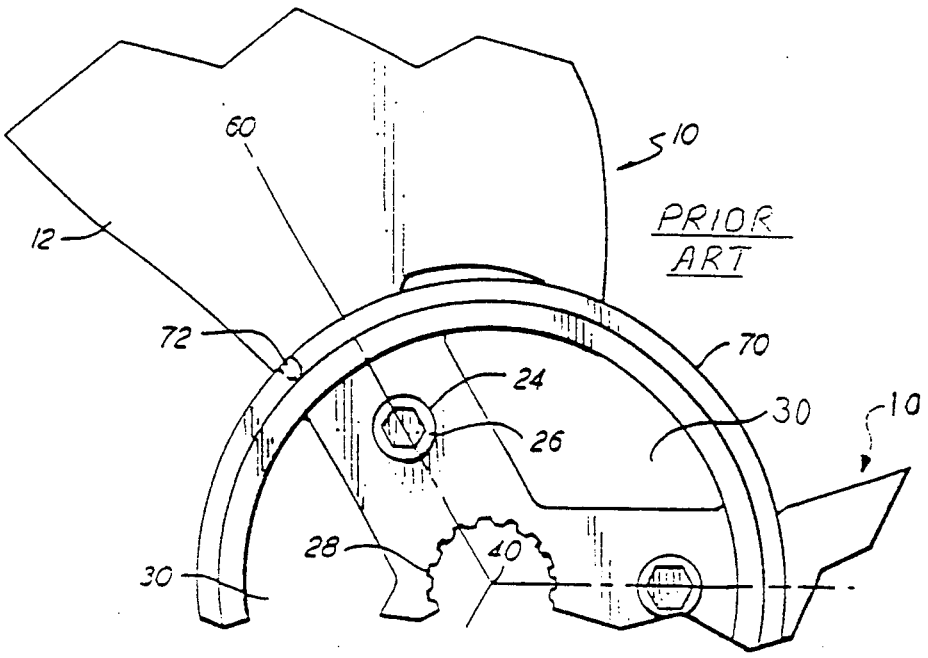
FIG. 2 is a partial end elevation of the propeller assembly of FIG. 1.

Referring to FIGS. 1 and 2, the prior art arrangement (U.S. Pat. No. 4,792,279), three propeller blades (10) are supported by a hub (20), however, only one blade is shown in detail. Each blade has a blade face (12) and a blade shaft (14). Blade shaft (14) has a helical groove (16). A substantially cylindrical central hub (20) contains three bores (22) extending radially from the axis of rotation (40) of the hub (and propeller assembly) each adapted to rotatably receive a blade shaft (14). The rotation of the blade shaft (14) in a radial bore (22) is restricted by the length of the helical groove (16) when a guide pin (18) is passed through a guide pin bore (24) to intersect blade shaft (14) and rest within helical groove (16). The guide pin (18) is secured therein by guide pin screw (26). Central hub (20) additionally defines an axially extending drive shaft bore (28) which receives a motor powered drive shaft.

Rotation of a drive shaft (not shown) secured in the drive shaft bore (28) causes rotation of the central hub (20) about its axis of rotation (40). Centrifugal force resulting from rotation of the central hub (20) acts on the blades (10) to move them outwardly away from the axis of rotation (40). Central hub (20) additionally contains three substantially triangular ports (30), running longitudinally therethrough parallel to the axis of rotation (40), capable of venting exhaust gases from the attached motor (not shown).

The helical groove (16) has a length (1), width (w) and angle ($\alpha$) on blade shaft (14), as can best be seen in FIG. 3. When blade (10) rotates in radial bore (22), with the guide pin (18) secured in place in helical groove (16) by guide screw (26), such rotation can only occur with movement of the entire propeller blade relative to the axis.

When the central hub (20) and blades (10) are rotated about the axis of rotation (40), centrifugal force acts on the blades (10). The blades (10) cannot move away from the central hub (20), without rotation in the radial bore (22), because the interaction of guide pin (18) and helical groove (16) which controls and defines the range of movement. Similarly, when the central hub (20) and blades (10) are rotated about the axis of rotation (40) resistance from contact with water exerts a resultant force on the blade face (12). This force acts at a center of pressure (50) on the blade face (12). The center of pressure (50) is displaced from the pitch change axis (60) defined by the axis of the associated radial bore (22) to produce a force opposite that produced by centrifugal force to urge the rotation of the blade(s) (10) in the radial bore (22) in the opposite direction to the rotation caused by centrifugal force. Due to the guide pin (18) and the helical groove (16), the rotation of blade shaft (14) in radial bore (22) necessitates the movement of the blade (10) inwardly toward the axis of rotation (40) of the central bore (20) in the direction opposite and against centrifugal force.

Blade rotation occurs according to the length and angle of helical groove (16) on blade shaft (14) which is engaged by guide pin (18) secured to central hub (20) by guide pin screw (26). The design and shape of blade face (12) and the angle of helical groove (16) is such that the rotation caused by force on the center of pressure (50) results in blade (10) moving along helical groove (16) inwardly toward the axis of rotation (40) of the central hub (20).

The helical groove (16) on blade shaft (14) is disposed at angle $\alpha$ to the length of the shaft (14). The range of pitches which the propeller may have is a function of this angle $\alpha$ and the length of groove (16). Similarly, the propelled diameter range available to the propeller assembly is also a function of these values.

When the central hub (20) begins to turn about axis of rotation (40) the force of resistance on blade face (12) caused by contact with the water yields a resultant force on the center of pressure (50). This force on the center of pressure (50) initially exceeds the centrifugal force acting on the blades (10). Accordingly, the rotation of the blade (10) within radial bore (22) will be about pitch axis (60) in the direction of the force on center of pressure (50). Helical groove (16) disposed on blade shaft (14) is at an angle $\alpha$ such that rotation of blade (10) about pitch axis (60) results in a decrease in pitch (toward a feathered condition) and movement of the blade (10) inwardly toward the central hub (20). Thus, a decrease in pitch is accompanied by a decrease in the propelled diameter.

As the speed of the central hub (20) increases, the centrifugal force on the blades (10) increases at a greater rate than the increase in force due to resistance. Thus, the centrifugal force will eventually equal and then exceed the force of the water resistance. When this occurs, blade (10) moves away from the central hub (20). This movement is accompanied by rotation of the blade (10) in the radial bore (22) about the pitch axis (60). This rotation is in the opposite direction of that caused by the force of water resistance. Therefore, the rotation due to centrifugal force causes the blade face (12) to move against the center of pressure (50) to a coarser pitch. Thus, as the speed increases, both the pitch and diameter of the blade also increase.

A ring (70) is mounted on the rear end of the central hub (20). This ring may be used in combination with attaching means (72) which serve to connect that ring to the ends of the blades (10). The ring (70) is free to rotate about the axis of rotation (40) on the central hub (20). When the blades (10) are connected to the ring (70) with the attachment means (72), the rotation of the blade (10) about the axis of pitch rotation (60) is synchronized. This synchronization occurs because movement of the blades (10) about the pitch axis of rotation (60) causes movement of the attachment means (72) which turns ring (70). The movement of the ring (70) causes all blades (10) to move equal amounts in synchronism.

Now with reference to FIGS. 3 to 7, the improvements provided by the present invention will now be described. In these Figures, elements similar to those described with reference to FIGS. i and 2 will be given the same reference numerals, although it is to be understood that these elements may differ in some respects.

The first improvement is best illustrated in FIGS. 3 and 6. Here an insert (100), defining cam profile groove (16), constructed of a higher hardness material than is suitable for construction of the blade (10), is housed in a groove.(102). The insert (100) has a snug sliding fit so that it is firmly supported by the shaft while being easily removable for replacement at very low cost upon unacceptable wear of the cam profile or to change the cam profile to adjust the shift characteristics of the propeller. The base of the groove (102) locates the outer reaches of insert (100) closely adjacent the outer surface of the blade shaft (14) whereby the insert is held captively in place by the bore (22) when the shaft (14) is received therein.

Springs (104), one for each blade (10), are connected between an extension of the attaching means, in the form of pins (72), attached to the trailing edge of each blade (10), passing through pin guide openings in ring (70) and clearance openings in a ring support extension of hub (20) radially inwardly into the exhaust ports (30) where they terminate at tension spring (104) engaging grooves (106). Tension springs (104) extend, into the ports (30), to spring supports (108) fixedly attached to hub (20). Springs (104) are under tension all of the time and bias the blades (10) to their lowest pitch. Of course, because of the synchronizing function of the ring (70) and pins (72), one spring (104) would suffice. However, one spring (104) per blade (10) is preferred. Such an arrangement permits one or even two springs to fail without losing the desired bias. It should be noted that the biasing force applied by springs (104) is small compared with the opposing forces controlling the blade pitch changes and that this biasing force is sufficient only to bias the blades to minimum pitch when no significant centrifugal forces are exerted on the blades.

Minimum pitch shims (110) (embodiment of FIG. 4), disposed axially between ring (70) and hub (20) are used to adjust the axial position of the ring (70) relative to the hub (20) thereby to preset the minimum pitch of the propeller.

As an alternative adjustment method (and one which is infinite rather than incrementally adjustable), adjustable set screws (111) protruding out from the end of the blade's shaft (14) may be provided. These screws engage the propeller shaft to limit how far the blades can retract into the hub (thus limiting how low the blades pitch down). These set screws (111) are adjustable and are shown in FIG. 6. Besides being infinitely adjustable, the set screw method is stronger than the shim method since it avoids transmitting additional loads through the relatively weak plastic diffuser ring.

Of course, it will be appreciated that shims between the end of the blade shaft (14) and the propeller shaft (or the innermost extension of the bore (22)) could be used to limit pitch down.

Maximum pitch stop screw (112) extends in a threaded bore in the hub (20) substantially circumferentially of the ring support extension (114) where it engages a pin (72). Screw (112) is reached for adjustment by way of opening (118) in that extension and opening (116) in the ring (70), which provides clearance within the permitted range of movement of the ring (70). Pin (72) limits maximum pitch of the blades by its abutment with adjustable screw (112) (as shown in FIG. 5).

A further improvement is illustrated in FIG. 4, and this allows remote control of the shifting. By including a detent ball (120) and cam (122) arrangement (which may be either mechanically or, preferably, hydraulically actuated), in the propeller shaft (124), which bears against the end (126) of the blade shaft (14) (or against the low pitch shaft stop screws shown in FIG. 6 if this low pitch limit method is combined with the remote shift control here discussed), the propeller can be forced into an upshift at any time by longitudinally moving the remote controlled propeller shaft cam (122) rearwardly, along the axis of rotation, to move the ball (120) radially outwardly to move the blade in a direction to increase its pitch. This requires no complicated changes to the propeller design or substantial increase in the overall complexity of the engine's gear case. It also does not interfere with simple removal and replacement of the propeller. Nor does it preclude the use of existing fixed pitch propellers on the same propeller shaft. The ball and cam (120, 122) arrangement can also set minimum pitch by limiting the possible movement of cam (122) to the left as seen in FIG. 4, thereby avoiding the need for shims (110) or the set screw (111) shown in FIG. 6. Alternatively hydraulic fluid under pressure could be routed directly to the cavity under blade shafts, via holes in the propeller shaft with suitable O-ring seals on the blade shafts and propeller shaft, to control upshifting of blade pitch as desired.

By altering the blade profile of cam (16), the propeller can be made either fully automatic with manual upshift override, or fully manually shifting (by using a low cam lead angle which is always trying to downshift).

It will also be appreciated that the blade controlling cam profile (16) could be of a material harder than the blade (10) itself while being mounted to or formed in the hub (20) with the cam follower (18) being supported by the shaft (14) for engagement by the cam profile (16) to control blade pitch.

The above embodiment is meant to survey as an example of the present invention and not meant to limit it in any way. Many alternative embodiments are possible including propeller assemblies having more or less than three blades.

I claim:

1. An automatic variable pitch marine propeller comprising:

a central hub defining a rotation axis, said central hub having a radial bore receiving a propeller blade shaft, and a guide pin bore receiving a guide pin, said guide pin bore being parallel to said propeller rotation axis and intersecting perpendicularly said radial bore; and a propeller blade comprising said blade shaft and a blade portion, said blade shaft being attached to said blade portion at one end and extending away from said blade portion into said radial bore, said blade shaft being capable of rotation within said radial bore about an axis of pitch rotation, said blade shaft having an opening closely housing a cam defining insert in which is formed a cam groove to receive said guide pin, said blade portion being configured and attached to said blade shaft such that force due to water pressure on said blade portion defines a center of pressure which is located remote from the axis of pitch rotation;

said guide pin passing through a said guide pin bore and being received by said cam groove wherein said cam groove, by way of cooperation between said insert and said shaft, defines pitch of the associated said propeller blade by controlling its rotation within said radial bore about its axis of pitch rotation; wherein during operation of said propeller, by virtue of the interaction of said guide pin with said cam groove and the cooperation of said insert with said shaft, centrifugal force tends to increase pitch and diameter in opposition to said force due to water pressure acting on said propeller blades tending to reduce pitch and diameter.

2. A propeller according to claim 1 wherein said insert has a greater hardness than said propeller blade.

3. A propeller according to claim i wherein a cam means is positioned to cooperate with the radially inner end of said blade shaft, said cam means being operable to move said blade shaft radially outwardly thereby, by way of said interaction, to overcome said force due to water pressure to increase blade pitch when desired.

4. A propeller according to claim 3 wherein said cam means comprises an operating shaft extending axially along said rotation axis, within a drive shaft upon which said hub is mounted, to a cam surface, adjacent said radial bore, with which a cam follower, located in a radial opening in said drive shaft, cooperates, said cam follower interacting between said cam surface and said blade shaft to convey pitch increase dictates of said cam means thereto upon longitudinal movement of said operating shaft to move said cam follower radially outwardly in said radial opening.

5. A propeller according to claim 1 comprising means associated with the radially innermost end of said blade shaft for limiting the radially inward movement of said blade shaft into said radial bore, thereby to determine minimum blade pitch.

6. A propeller according to claim 5 wherein said means is a threaded means adjustably supported in a threaded bore extending axially into said blade shaft and arranged to abut the radially innermost end of said radial bore to limit said radially inward movement.

7. A propeller according to claim 5 wherein said radially inward movement is limited by a drive shaft upon which said hub is mounted.

8. A propeller according to claim 4 wherein said longitudinal movement of said operating shaft is limited to determine minimum blade pitch.

9. A propeller according to claim 4 wherein an adjustable means is disposed between said cam follower and said blade shaft to determine minimum blade pitch.

10. A propeller according to claim 1 wherein resilient means connected between said blade and said hub bias said blade to its minimum blade pitch.

11. An automatic variable pitch variable diameter marine propeller comprising:

a central hub defining rotation axis, said central hub having three exhaust ports extending longitudinally therethrough, three radial bores interdigitated with said ports, each of said radial bores receiving one of three propeller blade shafts, and three guide pin bores each receiving one of three guide pins, each of said guide pin bores being parallel to said propeller rotation axis and intersecting perpendicularly with said radial bore; and three propeller blades, each of said blades comprising one of said blade shafts and a blade portion, said blade shaft being attached to said blade portion at one end and extending away from said blade portion into said radial bore, said blade shaft being capable of rotating within said radial bore about an axis of pitch rotation, said axis of pitch rotation being normal to said axis of propeller rotation, said blade shaft having an opening closely housing a cam defining insert in which is formed a cam groove to receive a said guide pin, said blade portion being configured and attached to said blade shaft such that force due to water pressure on said blade portion defines a center of pressure which is located remote from the axis of pitch rotation;

each of said guide pins passing through said guide pin bore and being received by said cam groove wherein said cam groove defines pitch of the associated said propeller blade by controlling its rotation within said radial bore about its axis of pitch rotation; wherein during operation of said propeller, by virtue of the interaction of said guide pins with said cam grooves and the cooperation of said inserts with said shafts, centrifugal forces tends to increase pitch and diameter in opposition to said force due to water pressure acting on said propeller blades tending to reduce pitch and diameter.

12. A propeller according to claim 11 comprising synchronization means to synchronize the varying pitches of the propeller blades, comprising a ring rotatably mounted on said central hub, and attachment means locating said propeller blades relative to the ring.

13. A propeller according to claim 11 wherein a cam means is positioned to cooperate with the radially inner end of said blade shafts, said cam means being operable to move said blade shafts radially outwardly thereby, by way of said interaction, to overcome said force due to water pressure to increase blade pitch when desired.

14. A propeller according to claim 13 wherein said cam means comprises an operating shaft extending axially along said rotation axis, within a drive shaft upon which said hub is mounted, to a cam surface, adjacent said radial bores, with each of which a cam follower, located in a radial opening in said drive shaft, cooperates, each said cam follower interacting between said cam surface and its associated said blade shaft to convey pitch increase dictates of said cam means thereto upon longitudinal movement of said operating shaft to move said cam follower radially outwardly in said radial opening.

15. A propeller according to claim 14 wherein the cam surface is a frusto-conical surface concentric with said rotation axis and said cam followers are balls.

16. A propeller according to claim 12 comprising a shim disposed between said hub and said ring to determine minimum blade pitch.

17. A propeller according to claim 12 comprising stop means interacting between said hub and said ring to determine maximum blade pitch.

18. A propeller according to claim 17 wherein said stop means comprises an adjustable set screw supported in said ring and a stop surface in said hub to engage said set screw to determine maximum blade pitch.

19. An automatic variable pitch marine propeller comprising:

a central hub defining a rotation axis, said central hub having a radial bore receiving a propeller blade shaft, and a guide pin bore receiving a guide pin, said guide pin bore being parallel to said propeller rotation axis and intersecting perpendicularly said radial bore;

a propeller blade comprising said blade shaft and a blade portion, said blade shaft being attached to said blade portion at one end and extending away from said blade portion into said radial bore, said blade shaft being capable of rotation within said radial bore about an axis of pitch rotation, said blade shaft having an opening closely housing a cam defining insert in which is formed a cam groove to receive said guide pin, said blade portion being configured and attached to said blade shaft such that force due to water pressure on said blade portion defines a center of pressure which is located remote from the axis of pitch rotation;

said guide pin passing through a said guide pin bore and being received by said cam groove wherein said cam groove, by way of cooperation between said insert and aid shaft, defines pitch of the associated said propeller blade by controlling its rotation within said radial bore about its axis of pitch rotation; wherein during operation of said propeller, by virtue of the interaction of said guide pin with said cam groove and the cooperation of said insert with said shaft, centrifugal force tends to increase pitch and diameter in opposition to said force due to water pressure acting on said propeller blades tending to reduce pitch and diameter, and said insert is held captive in said opening by said radial bore.

* * * * *